US008655202B2

(12) United States Patent
Fukita et al.

(10) Patent No.: US 8,655,202 B2
(45) Date of Patent: Feb. 18, 2014

(54) TONER CONTAINER, DEVELOPING DEVICE, PROCESS CARTRIDGE AND IMAGE FORMING APPARATUS

(75) Inventors: Taku Fukita, Mishima (JP); Toshikazu Tsuchiya, Mishima (JP); Masafumi Monde, Yokohama (JP); Hidetoshi Hanamoto, Mishima (JP); Tsutomu Ishida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 252 days.

(21) Appl. No.: 13/323,018

(22) Filed: Dec. 12, 2011

(65) Prior Publication Data

US 2012/0148271 A1 Jun. 14, 2012

(30) Foreign Application Priority Data

Dec. 14, 2010 (JP) ..... 2010-278392

(51) Int. Cl.
*G03G 15/08* (2006.01)

(52) U.S. Cl.
USPC ..... 399/27

(58) Field of Classification Search
USPC ..... 399/27, 61
See application file for complete search history.

(56) References Cited

U.S. PATENT DOCUMENTS

| | | | | |
|---|---|---|---|---|
| 5,755,358 | A * | 5/1998 | Fisk | 222/23 |
| 6,463,225 | B1 * | 10/2002 | Abe et al. | 399/27 |
| 2011/0097124 | A1 * | 4/2011 | Koike et al. | 399/358 |

FOREIGN PATENT DOCUMENTS

| | | |
|---|---|---|
| JP | 64-6986 | 1/1989 |
| JP | 2251874 | 10/1990 |
| JP | 6-289714 | 10/1994 |
| JP | 2001-0765585 | 3/2001 |
| JP | 2005-195791 | 7/2005 |

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

A toner container includes a toner accommodating portion: a rotatable toner stirring member; a sensor for detecting a remaining amount of the toner; wherein the sensor includes a first flexible sheet portion, a second sheet portion, a first opening, a first electroconductive portion, a second electroconductive portion, wherein the first sheet portion flexes by a stirring operation of the stirring member, and the first electroconductive portion is contacted to the second electroconductive portion, by which the remaining toner amount is detectable, and wherein the toner accommodating portion is provided with a second opening for communicating the first opening and an outside of the toner accommodating portion with each other.

10 Claims, 17 Drawing Sheets

(a)

A - A (b)

B - B (c)

(a)

(b)

(c)

(d)

(a)

A - A (b)

B - B (c)

(a)

(b)

(c)

(a)

A - A (b)

B - B (c)

(a)

(b)

(a)

(b)

(a)

(b)

(a)

(b)

TONER CONTAINER, DEVELOPING DEVICE, PROCESS CARTRIDGE AND IMAGE FORMING APPARATUS

FIELD OF THE INVENTION AND RELATED ART

The present invention relates to a toner container, a developing device, and an image forming apparatus.

There has been known that a pressure sensor, an ultrasonic wave sensor, and the like, are usable as the sensors for detecting the amount of the residual toner (which hereafter may be referred to simply as "residual toner amount") in the toner storage of a developing device. For example, Japanese Laid-open Patent Application H01-6986 discloses a hopper provided with a pressure sensor as a means for detecting the residual toner amount. In this case, the pressure sensor is attached to the bottom wall of the hopper, with its pressure sensing portion facing upward. More specifically, it is attached to the adjacencies of the area where the thin blade of the toner agitator of the hopper passes as the agitator is rotated. Thus, the amount of the residual toner in the hopper is determined by calculating the ratio of the "length of time pressure is detected by the sensor while the agitator is rotated once" relative to the "length of time it takes for the agitator to rotate once".

However, the hopper disclosed in Japanese Laid-open Patent Application H01-6986 suffers from the following problem. That is, when the amount of the residual toner in the hopper is no less than a preset value, the output of the sensor is fixed to the toner presence logic level. However, as the amount of the residual toner falls below the preset value, the sensor does not detect the residual toner amount at all. That is, the sensor output is fixed to the no toner logic level. More specifically, when the residual toner amount is substantial, the sensor always detects pressure regardless of the actual value of the residual toner amount. Therefore, the actual amount of the residual toner cannot be detected until the residual toner amount in the hopper falls below a certain value. In other words, it is impossible for the sensor to accurately and successively detect the residual toner amount from when the hopper is completely full of toner to when it runs out of toner.

In recent years, demand for a high speed image forming apparatus has been rapidly increasing. Thus, the toner stirring member (which hereafter will be referred to simply as stirrer) has been increased in rotational speed. However, increasing the stirrer resulted in the following problem. That is, as the residual toner amount falls below a certain value, the toner is continuously whirled up by the stirrer, and then, lands on the detection surface of the sensor, covering the detection surface of the sensor, until the image forming apparatus runs out of toner. In other words, it is possible for the toner to be continuously present on the detection surface of the sensor. With the detection surface of the sensor being continuously covered with toner, it is virtually impossible for the sensor to detect the length of time it is not under pressure. Therefore, it is impossible to accurately determine the residual toner amount.

There are a pressure sensitive resistor and a sheet switch, such as the one disclosed in Japanese Laid-open Patent Application 2001-76585. The pressure sensitive resistor disclosed in this patent application has a pair of sheets positioned face to face (in parallel) with the presence of a preset gap between them. It is structured so that as one of the sheets is made to deform by pressure, the two sheets come into contact with each other. Thus, it can detect the presence of pressure, based on the state of contact between the two sheets. In a case where a sensor such as the one disclosed in Japanese Laid-open Patent Application 2001-76585 is used as the sensor for detecting the residual toner amount, the sensor requires a hole (air vent) to keep the pressure in the space (gap) between the two sheets, equalized with the atmospheric pressure. Thus, it is possible to employ this type of sensor as a residual toner amount detection sensor.

However, if a sensor such as the above described one is placed in the toner storage, it is possible for toner particles, dust particles, and the like to enter the space in the sensor through the aforementioned air vent, and cause the sensor to inaccurately detect the residual toner amount. Further, in a case where the wall of a toner storage is provided with a hole, and this hole is used to connect the air venting hole of a residual toner amount detection sensor to the atmosphere, it is possible that the air vent is blocked by the elastic seal placed in the adjacencies of the hole of the wall of the toner storage to prevent the toner from leaking from the toner storage.

As will be evident from the description of the conventional sensors for detecting the residual toner amount, the conventional residual toner amount sensors cannot accurately and successively detect the amount of the residual toner in a toner storage.

SUMMARY OF THE INVENTION

Thus, the primary object of the present invention is to provide a developing device and an image forming apparatus, which have a residual toner amount sensor capable of accurately and successively detecting the amount of the residual toner in their toner storage.

According to an aspect of the present invention, there is provided a toner container comprising: a toner accommodating portion: a rotatable stirring member provided in said toner accommodating portion to stir the toner; a sensor provided on an inner surface of said toner accommodating portion to detect a remaining amount of the toner accommodated in said toner accommodating portion; wherein said sensor includes a first flexible sheet portion provided at a position opposing said stirring member; a second sheet portion provided between an inner surface of said toner accommodating portion and said first sheet portion with a gap from said first sheet portion; a first opening provided in said second sheet portion so as to be in communication with a space surrounded by said first sheet portion and said second sheet portion; a first electroconductive portion provided on a surface of said first sheet portion opposing said second sheet portion; and a second electroconductive portion provided on a surface of said second sheet portion opposing said first sheet portion, wherein said first sheet portion flexes by a stirring operation of said stirring member, and said first electroconductive portion is contacted to said second electroconductive portion, by which said remaining toner amount is detectable, and wherein said toner accommodating portion is provided with a second opening for communicating said first opening and an outside of said toner accommodating portion with each other.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

[Embodiment 1]

<1-1: General Structure of Image Forming Apparatus>

Figure 1:
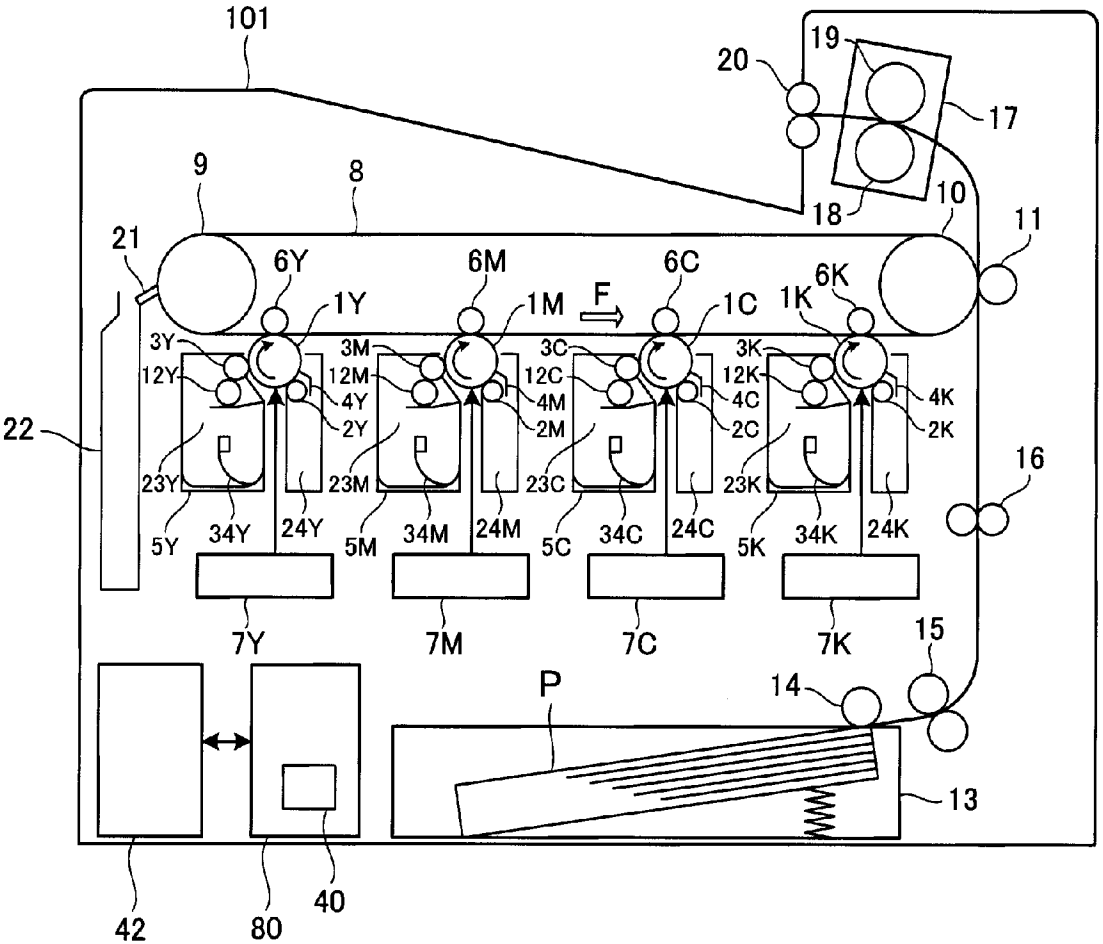
FIG. 1 is schematic sectional view of the image forming apparatus in the first preferred embodiment of the present invention, and shows the structure of the apparatus.

Referring to FIG. 1, an image forming apparatus in this embodiment, which is an example of a color laser printer, is described about its general structure. The color laser printer employs process cartridges 5Y, 5M, 5C and 5K, which are removably installable in the main assembly 101 of the printer. The four process cartridges 5Y, 5M, 5C and 5K are the same in structure, but are different in the color of the toner therein (yellow (Y), magenta (M), cyan (C) and black (K)).

Each of the process cartridges 5Y, 5M, 5C and 5K comprises three primary image formation units, that is, a latent image formation unit, a development unit (developing device), and a waste toner unit. The developing devices Y, M, C and K have development rollers 3Y, 3M, 3C and 3K (developing members), toner supply rollers 12Y, 12M, 12C and 13K, toner storages 23Y, 23M, 23C and 23K, toner stirring sheets 34Y, 34M, 34C and 34K (stirring member made of Mylar), respectively. In operation, the toner in the toner storage 23 is stirred by the stirring sheet 34, and is delivered to the peripheral surface of the photosensitive drum 1 by way of the toner supply roller 13 and development roller 3.

The stirring member 34 (made of Mylar) is a thin and flexible member, and is 150 μm in thickness. It is rotated in a preset direction. As it is rotated, it stirs the toner in the toner storage. The latent image forming units Y, M, C and K have photosensitive drums 1Y, 1M, 1C and 1K, charge rollers 2Y, 2M, 2C and 2K, respectively. The waste toner units Y, M, C and K have drum cleaning blades 4Y, 4M, 4C and 4K, and waste toner storages 24Y, 24M, 24C and 24K, respectively.

The latent image formation units Y, M, C and K have laser units 7Y, 7M, 7C and 7K (exposure units), which are below the process cartridges 5Y, 5M, 5C and 5K, respectively, and scan (expose) the peripheral surfaces of the photosensitive drums 1Y, 1M, 1C and 1K with the beams of laser light which they project in response to image formation signals. More concretely, the photosensitive drums 1Y, 1M, 1C and 1K are rotated. As they are rotated, they are uniformly charged to the negative polarity by the charge rollers 2Y, 2M, 2C and 2K to a preset potential level. Then, they are exposed by the laser units 7Y, 7M, 7C and 7K, respectively. Consequently, four electrostatic latent images are formed on the photosensitive drums 1Y, 1M, 1C and 1K, one for one. These electrostatic latent images are developed into four monochromatic toner images, different in color, by the negatively charged toner delivered to the electrostatic latent images.

An intermediary transfer belt unit has an intermediary transfer belt 8, a driver roller 9, and a belt backing roller 10 (which back up intermediary transfer roller against transfer roller). It has also primary transfer rollers 6Y, 6M, 6C and 6K, which oppose photosensitive drums 1Y, 1M, 1C and 1K, respectively, from the inward side of the loop which the intermediary transfer belt 8 forms. To each primary transfer roller 6, transfer bias is applied from an unshown bias applying means.

Regarding the transfer of a toner image, as positive bias is applied to the primary transfer rollers 6Y, 6M, 6C and 6K four toner images on the photosensitive drums 1Y, 1M, 1C and 1K are sequentially transferred (primary transfer) onto the intermediary transfer belt 8, starting from the photosensitive drum 1Y. Consequently, the four toner images are layered on the intermediary transfer belt 8. Then, the layered four toner images on the intermediary transfer belt 8 are conveyed to the transfer station where the secondary transfer roller 11 (transferring member) is present.

The image forming apparatus has: a sheet feeding device; a sheet cassette 13 in which multiple sheets P of recording medium are stacked; and a pair of recording medium conveyance rollers 15. The sheet feeding device has a sheet feeding roller 14. As an image forming operation is started, the sheets P in the sheet cassette 13 are fed one by one, while being separated from the rest, into the main assembly 100 of the printer from the sheet cassette 13 by the sheet feeding roller 14. After being fed into the main assembly, each sheet P of recording medium is conveyed by a pair of registration rollers 16 to where the sheet P is made to oppose the secondary transfer roller 11 across the intermediary transfer belt 8.

While the sheet P of recording medium is conveyed through the nip between the secondary transfer roller 11 and intermediary transfer belt 8, the color toner image (made up of layered four toner images) on the intermediary transfer belt 8 is transferred (secondary transfer) by the positive bias applied to the secondary transfer roller 11. Then, the sheet P of recording medium is conveyed to the fixing device 17, and is conveyed through the fixing device 17. As the sheet P is conveyed through the fixing device 17, the sheet P and the color toner image thereon are subjected to the combination of the heat and pressure applied by the fixation film 18 and pressure roller 19 of the fixing device 17. As a result, the color toner image is fixed to the surface of the sheet P. Then, the sheet P is discharged from the main assembly 100 of the printer by a pair of discharge rollers 20.

Meanwhile, the toner remaining on the photosensitive drums 1Y, 1M, 1C and 1K is removed by the cleaning blades 4Y, 4M, 4C and 4K, and is recovered into waste toner recovery containers 24Y, 24M, 24C and 24K, respectively. As for the toner remaining on the intermediary transfer belt 8 after the transfer (secondary transfer) of the color toner image onto the sheet P of recording medium, it is removed by a transfer belt cleaning blade 21, and is recovered into a waste toner recovery container 22.

Referring to FIG. 1, designated by a referential code 40 is the chip which comprises the electric circuit (micro computer, which hereafter is referred to as CPU) for controlling the printer main assembly. The CPU controls the power source (unshown) involved with the conveyance of a sheet P of recording medium, and power source (unshown) for the process cartridges. It also controls the image forming operation of the printer, the detection of operational troubles of the printer, and the like. That is, the CPU integrally controls the various operations of the printer.

Designated by a referential code 42 is a video controller for controlling the emission of the beam of laser light from the laser unit based on the image formation data. The video controller 42 interfaces with a user through the unshown control panel of the printer. The control panel is capable of showing the remaining amount of each of the four toners, different in color, in the form of a bar graph. The referential codes Y, M, C and K in FIG. 1 stand for yellow, magenta, cyan, and black colors, respectively. Hereafter, if various portions of the printer, which are different only in terms of the color of the toner with which they are involved, are the same in structure, the referential codes Y, M, C and K are eliminated to describe them together.

<1-2: General Structure of Sensor>

Figure 2:
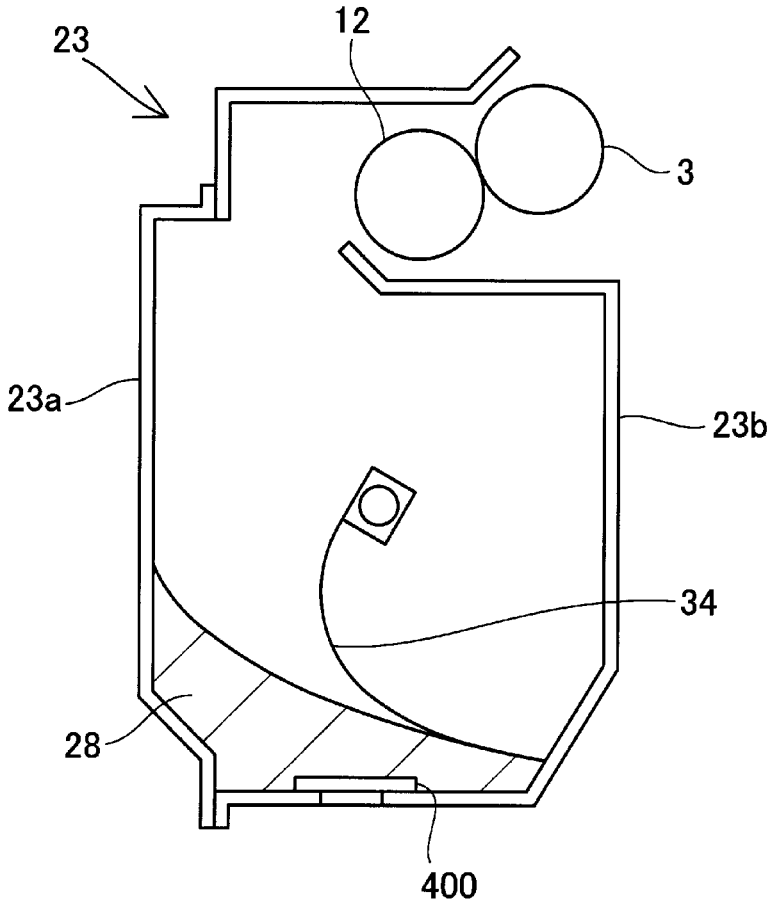
FIG. 2 is a schematic sectional view of the developing device in the first embodiment, and shows the structure of the device.

Next, referring to FIG. 2, the general structure of the developing device is described. Designated by referential codes 23*a* and 23*b* are a pair of shells of which the toner storage 23 is made. Designated by a referential code 28 is the toner, that is, the developer, in the toner storage 23, which is made up of the external walls 23*a* and 23*b*. In this embodiment, the sensor 400 capable of detecting the amount (residual amount) of the toner in the toner storage 23 is attached to the inward surface of the bottom wall of the toner storage 23.

The sensors usable for detecting the amount of the residual toner in the toner storage 23 can be grouped into two types, that is, a pressure sensitive resistor type, and a sheet switch type (membrane switch type). The sensor 400 may be of either type. A residual toner amount sensor of the pressure sensitive resistor type detects the residual toner amount in the toner storage 23 based on the changes in its electrical resistance. More concretely, as the toner stirring member in the toner storage 23 is rotated, the amount of the pressure to which the sensor is subjected changes. Therefore, the sensor is turned on or off. Further, as the residual toner amount changes, the amount of pressure which the body of the residual toner in the toner storage applied to the sensor changes, which in turn changes the size of the area of contact between the two patterned wires of the sensor. Thus, the sensor changes in the amount of electrical resistance. Therefore, the residual toner amount can be detected based on the changes in the electrical resistance of the sensor. In comparison, the residual toner amount sensor of the sheet switch type detects the residual toner amount based on the ratio between the length of time the sensor is kept turned on by the pressure from the body of the toner in the toner storage 23, that is, the opposing two patterned wires of the sensor are kept in contact with each other by the body of toner, and the length of time they are not kept in contact with each other by the body of toner. Hereafter, the residual toner amount sensor 400 of the pressure sensitive resistor type is referred to simply as a pressure sensitive resistor 401, whereas the sensor 400 of the sheet switch type is referred to as sheet switch 421. First, the pressure sensitive resistor 401 is described, and then, the sheet switch 421 is described.

The pressure sensitive resistor 401 is made up of a pair of sheets, that is, the first and second sheets, which are positioned with the presence of a preset amount of gap between the two sheets. More specifically, one of the surfaces of each of the first and second sheets is provided with an electrode (patterned wire), and the two sheets are positioned so that the surface of the first sheet, which has the electrode, faces the surface of the second sheet, which has the electrode, with the presence of a preset amount of gap. It is structured so that as one of the two sheets is subjected to pressure, the pattered wire thereon is displaced in the direction to come into contact with the patterned wire on the other sheet. In this embodiment, the flexible sheet (first sheet) which has the detection surface (which is subjected to pressure from residual toner) is referred to as the "first sheet 305", whereas the other sheet (second sheet) which opposes the first sheet 305 is referred to as the "second sheet 306". The first and second sheets 305 and 306 are described later in detail.

Figure 3:
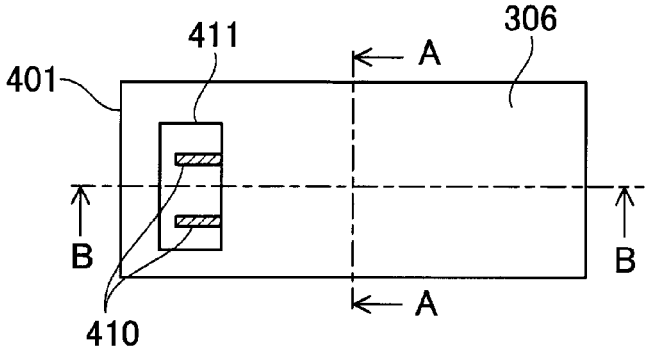
FIG. 3 is a schematic drawing for showing the structure of the residual toner amount sensor in the first embodiment, FIGS. 3(*a*), 3(*b*) and 3(*c*) being a plan view, a sectional view at the line A-A in FIG. 3(*a*), and a sectional view at the line B-B in FIG. 3(*a*), respectively.
Figure 3:
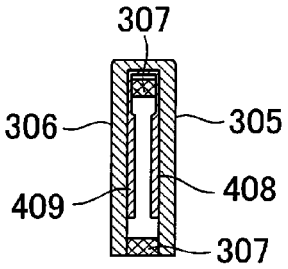
Figure 3:
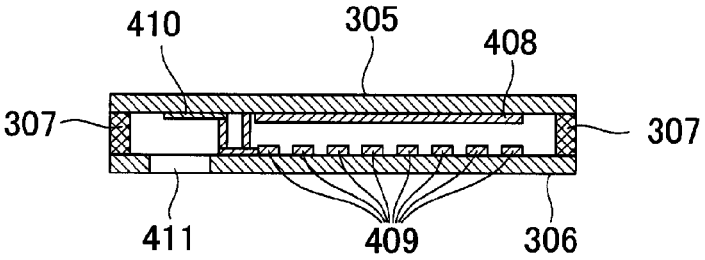
Figure 4:
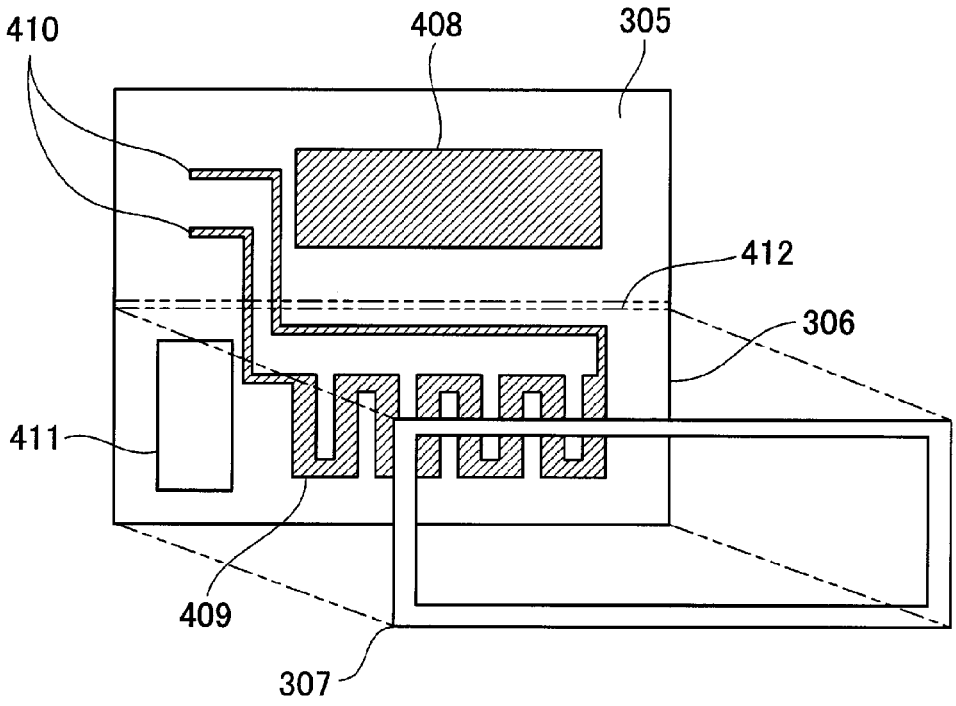
FIG. 4 is an exploded perspective view of the residual toner amount sensor in the first embodiment, and shows the structure of the sensor.

Next, referring to FIGS. 3 and 4, the pressure sensitive resistor 401 is described in more detail. FIG. 3 is a drawing of the pressure sensitive resistor 401, and shows the general structure of the pressure sensitive resistor 401. More specifically, FIG. 3(*a*) is a schematic plan view of the pressure sensitive resistor 401 as seen from the side of the opposite surface (by which sensor 401 is attached to toner storage wall) from the detection surface, that is, as seen from the second sheet side. FIG. 3(*b*) is a schematic sectional view of the pressure sensitive resistor 401 at a plane A-A in FIG. 3(*a*). FIG. 3(*c*) is a schematic sectional view of the pressure sensitive resistor 401 at a plane B-B in FIG. 3(*a*). FIG. 4 is drawing for describing the structure of the pressure sensitive resistor 401. Designated by referential codes 307 and 412 in FIG. 4 are a spacer and a folding line, respectively.

Referring to FIG. 4, the pressure sensitive resistor 401 is structured so that as the first sheet 305 is folded by 180° at a folding line 412, it squarely opposes the second sheet 306. That is, the two sheets are two parts of a single larger sheet. Incidentally, the first and second sheets 305 and 306 may be independent from each other. In a case where the first and second sheets 305 and 306 are made to be independent from each other, the sheet which is attached to the inward surface of the bottom wall of the toner storage is referred to as the second sheet, whereas the sheet having the detection surface is referred to as the first sheet.

As shown in the drawings, the inward surface of the first sheet 305 has a patterned wire 408 (electrically conductive first portion: an electrode, or patterned wire) formed by coating the inward surface of the first sheet 305 with electrically conductive ink, in a preset pattern. As for the second sheet 306, it has a patterned wire 409 (electrically conductive second portion) positioned so that it opposes the patterned wire 408 of the first sheet 305. The spacer 307 is in contact with the edge portions of the second sheet 306 and the edge portions of the first sheet 305, creating thereby a space, independent from the internal space of the toner storage 23, between the two sheets 305 and 306.

The patterned electrode 409 is provided with a pair of contact portions 410 which extend from the lengthwise ends of the patterned electrode 409, and which can be connected to external terminals. As is evident from FIG. 4, the contact portions 410 extend onto the inward surface of the first sheet 305.

The second sheet 306 is provided with a hole 411 (first hole), which opposes the contact portions 410 on the inward surface of the first sheet 305. Further, the bottom wall of the toner storage 23 is provided with a hole (unshown). Thus, the gap (space) between the second 306 and first sheet 305 is in connection to the outside of the toner storage 23 through the hole 411 of the second sheet 306 and the hole of the bottom wall of the toner storage 23. In other words, external terminals can be easily connected to the contact portions 410 through the hole 411.

Next, the operation of the pressure sensitive resistor 401 is described. Referring to FIG. 2, as the toner stirrer 34 (made of Mylar) is rotated to stir the toner in the toner storage 23, it is substantially curved by the resistance from the body of toner in the toner storage 23, in the opposite direction from the rotational direction of the stirrer 34. As it is curved, the detection surface of the first sheet 305 is subjected to the reaction force from the stirrer 34 through the body of toner in the storage 23, making it possible to detect the amount of the residual toner in the toner storage 23, assuming that the amount of the residual toner is proportional to the amount of the reaction force.

That is, the greater the amount of the residual toner in the storage 23, the greater the amount by which the toner stirrer 34 is curved, and therefore, the amount of pressure to which the first sheet 305 is subjected by the reaction force from the toner stirrer 34 when the stirrer 34 is rotated across the pressure sensitive resistor 401, through the body of toner in the toner storage 23. The greater the amount of the pressure to which the first sheet 305 is subjected, the greater the amount by which the first sheet 305 is deformed, and therefore, the larger the area of contact between the patterned wire 408 and patterned wire 409 (electrical resistance is smaller). On the other hand, when the amount of the residual toner in the toner storage 23 is small, the toner stirrer 34 is not curved much, and therefore, the amount of the pressure to which the first sheet 305 is subjected when the stirrer 34 is rotated across the pressure sensitive resistor 401 is small. Thus, the area of contact between the patterned wire 408 and patterned wire 409 is smaller (electrical resistance is larger) than when the amount of the residual toner is small.

In other words, the pressure sensitive resistor 401 can be used to determine the amount of the residual toner in the toner storage 23, based on the amount of electrical resistance between the patterned wires 408 and 409. Next, this subject is described in more detail with reference to FIGS. 5(*a*)-5(*c*).

Figure 5:
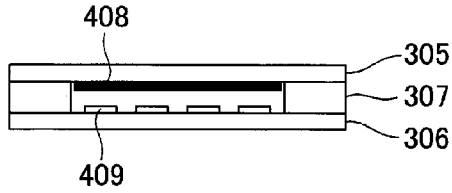
FIGS. 5(*a*), 5(*b*) and 5(*c*) are schematic sectional views of the residual toner amount sensor in the first embodiment, and shows how the sensor works.
Figure 5:
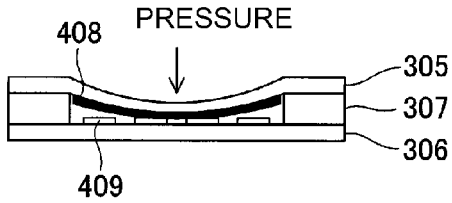
Figure 5:
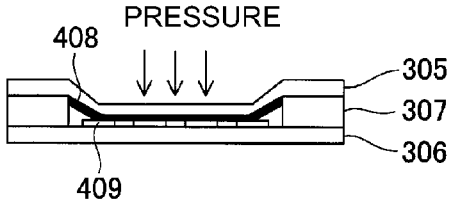
Figure 5:
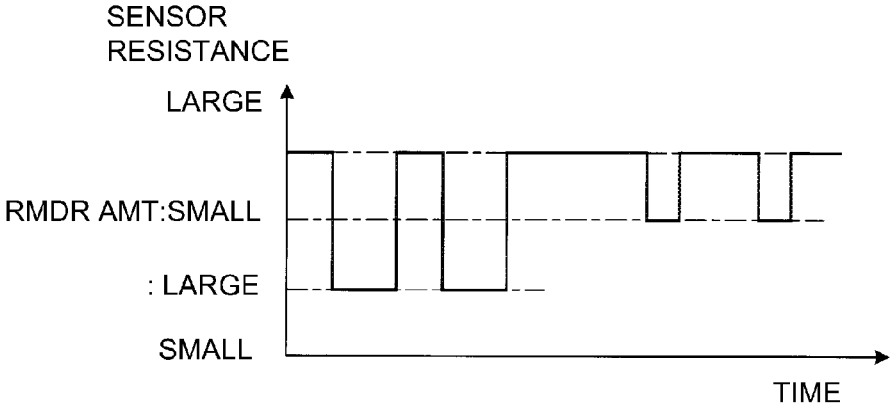

FIG. 5(*a*) shows the state of the pressure sensitive resistor 401 when no pressure is on the detection surface of the first sheet 305. When the pressure sensitive resistor 401 is in the state shown in FIG. 5(*a*), there is a gap (space) between the patterned wire 408 and patterned wire 409; the patterned wires 408 and 409 are not in contact with each other. FIG. 5(*b*) shows the state of the pressure sensitive resistor 401 when the detection surface of the first sheet 305 is under a small amount of pressure. When the pressure sensitive resistor 401 is in the state shown in FIG. 5(*b*), the deformation of the detection surface of the first sheet 305 has placed the patterned wire 408 in contact with only the two center portions of the patterned wire 409. FIG. 5(*c*) shows the state of the pressure sensitive resistor 401 when the detection surface of the first sheet 305 is under a large amount of pressure. When the pressure sensitive resistor 401 is in the state shown in FIG. 5(*c*), the patterned wire 408 of first sheet 305 is in contact with the four portions of the patterned wire 409 of the second sheet 306. Further, as the amount of pressure to which the detection surface of the first sheet 305 is subjected increases, the area of contact between the patterned wires 408 and 409 increases also in terms of the lengthwise direction (direction perpendicular to sheet of paper on which FIG. 5 is). In other words, the pressure sensitive resistor 401 is structured so that the electrical conductivity between the second and first sheets 306 and 305 changes in response to the changes in the amount of pressure (changes in amount of residual toner) to which the first sheet 305 is subjected.

Since the pressure sensitive resistor 401 is structured as described above, the amount of the electrical resistance between the second sheet 306 and first sheet 305 is inversely proportional to the amount of pressure to which the first sheet 305 is subjected. That is, referring to FIG. 5(*d*), the amount of electrical resistance between the second and first sheets 306 and 305 changes in response to the changes in the amount of the residual toner; the greater the amount of the residual toner, the smaller the amount of electrical resistance). Therefore, the amount of the residual toner in the toner storage 23 can be accurately and successively detected by detecting the amount of the electrical resistance between the second and first sheets 306 and 305.

Figure 6:
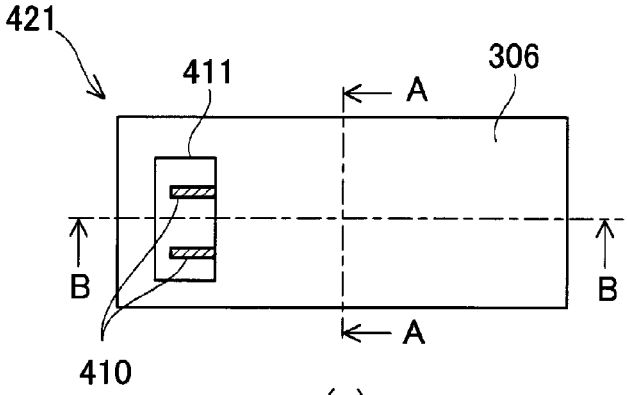
FIG. 6 is a schematic drawing for showing the structure of the residual toner amount sensor in the second embodiment, FIGS. 6(*a*), 6(*b*) and 6(*c*) being a plan view, a sectional view at the line A-A in FIG. 6(*a*), and a sectional view at the line B-B in FIG. 6(*a*), respectively.
Figure 6:
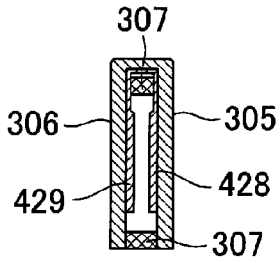
Figure 6:
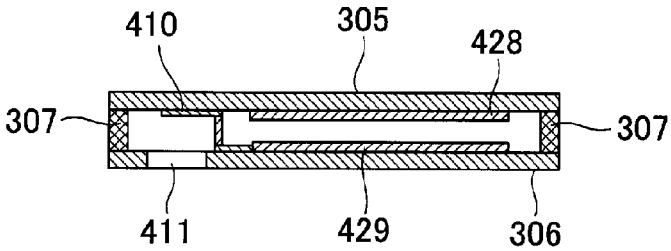
Figure 7:
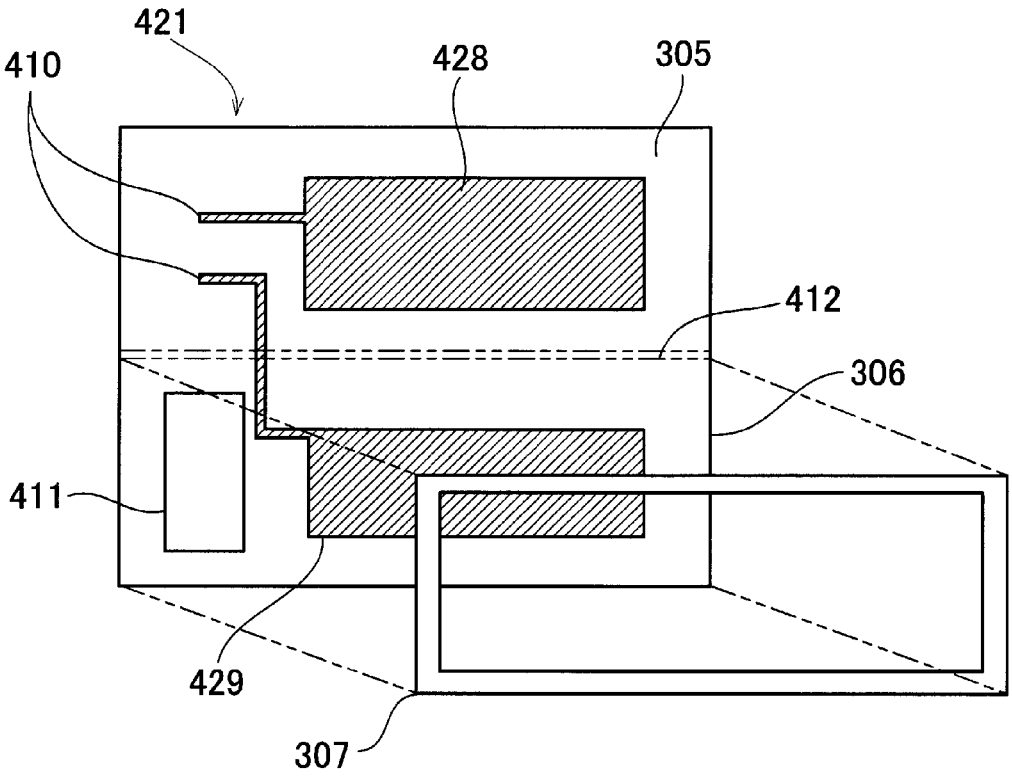
FIG. 7 is a schematic exploded perspective view of the residual toner amount sensor in the second embodiment, and shows the structure of the sensor.

Next, referring to FIGS. 6 and 7, the sheet switch 421, that is, the sensor of the other type, is described. FIG. 6 is for describing the general structure of the sheet switch 421. FIG. 6(*a*) is a schematic plan view of the sheet switch 421 as seen from the second sheet side. FIG. 6(*b*) is a schematic sectional view of the sheet switch 421 at the line A-A in FIG. 6(*a*), and FIG. 6(*c*) is a schematic sectional view of the sheet switch 421 at the line B-B in FIG. 6(*a*). FIG. 7 is for showing the structure of the sheet switch 421. The portions of the sheet switch 421, which are the same in shape and function as the counterparts of the above described pressure sensitive resistor 401 are given the same referential codes, and are not going to be described here.

Referring to FIG. 6(*c*), the outward surface of the first sheet 305 is the detection surface. There is an electrically conductive area (electrically conductive first portion) on the inward surface of the first sheet 305. As for the second sheet 306, it has an electrically conductive area 429 (electrically conductive second portion) on the inward surface of the second sheet 306, and therefore, the electrically conductive area 429 of the second sheet 306 opposes the electrically conductive area 428 of the first sheet 305. Further, there is a spacer 307 between the two sheets 305 and 306, providing a gap between the second sheet 306 and first sheet 305.

There are a pair of electrically conductive contact portions 410 at one of the lengthwise ends of the electrically conductive areas 428 and 429. The contact portions 410 can be connected to external terminals. More specifically, the contact portions 410 extend from the second sheet 306 and are extended onto the inward surface of the first sheet 305. Further, the second sheet 306 is provided with a hole 411, which coincides in position to the contact portions 410 on the inward surface of the first sheet 305.

Next, how the sheet switch 421 works is described. The sheet switch 421 is used to determine the amount of the residual toner in the toner storage 23 based on the length of time the detection surface of the first sheet 305 is under the pressure generated by the toner stirrer 34 (made of Mylar), that is, the length of time the first sheet 305 is kept deformed by the pressure generated by the toner stirrer 34 while the stirrer is rotated to stir the toner in the toner storage 23. That is, the greater the amount of the residual toner in the toner storage 23, the longer the length of time it takes for the stirrer 34 to move across the sheet switch 421, and therefore, the longer the length of time the detection surface of the first sheet 305 is kept pressed by the body of toner in the toner storage 23. On the other hand, when the amount of the residual toner in the toner storage 23 is small, the body of toner in the toner storage 23 is small in the amount of physical resistance. Therefore, the amount by which the stirrer 34 is deformed by the body of the residual toner is not curved as much, and therefore, the length of time it takes for the stirrer 34 to be moved across the sheet switch 421 is shorter; the shorter the length of time the first sheet 305 is subjected to the pressure. It is this phenomenon that is used to determine the amount of the residual toner in the toner storage 23.

Figure 8:
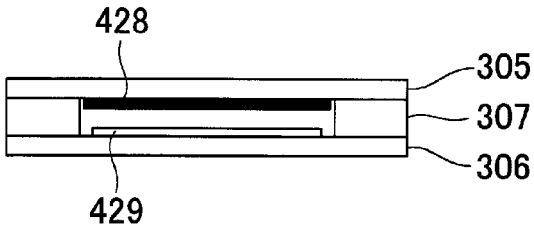
FIG. 8 is a schematic sectional view of the sensor in the first embodiment, and shows how the sensor works.
Figure 8:
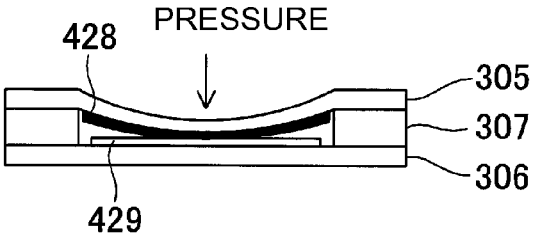
Figure 8:
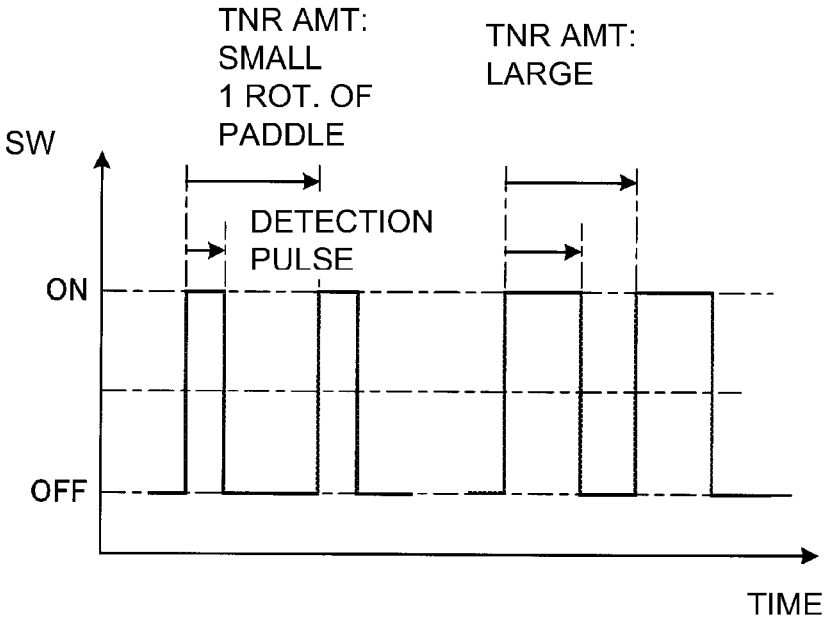

FIG. 8 shows how the sheet switch 421 works. FIG. 8(*a*) shows the state of the sheet switch 421 when no pressure is on the detection surface of the first sheet 305. When the sheet switch 421 is in the state shown in FIG. 8(*a*), there is a gap (space) provided by the spacer 307 between the electrically conductive areas 428 and 429 (two areas 428 and 429 are not in contact with each other). FIG. 8(*b*) shows the state of the sheet switch 421 when the sheet switch 421 is under the pressure. The top surface of the first sheet 305 is the detection surface. As the detection surface of the first sheet 305 is pressed, the first sheet 305 is deformed by the pressure, and therefore, the electrically conductive area 428 comes into contact with the electrically conductive area 429. In other words, the sheet switch 421 is changed in state from the Off-state to the ON-state.

Referring to FIG. 8(*c*), since the sheet switch 421 is structured as described above, the smaller the amount of the residual toner in the toner storage 23, the shorter the length of time it remains in the ON-state, whereas the larger the amount of the residual toner, the longer the length of time it remains in the ON-state. Therefore, the amount of the residual toner in the toner storage 23 can be accurately and successively determined by detecting the length of time the sheet switch 421 remains in the ON-state.

<1-3: Attachment of Sensors>

Figure 9:
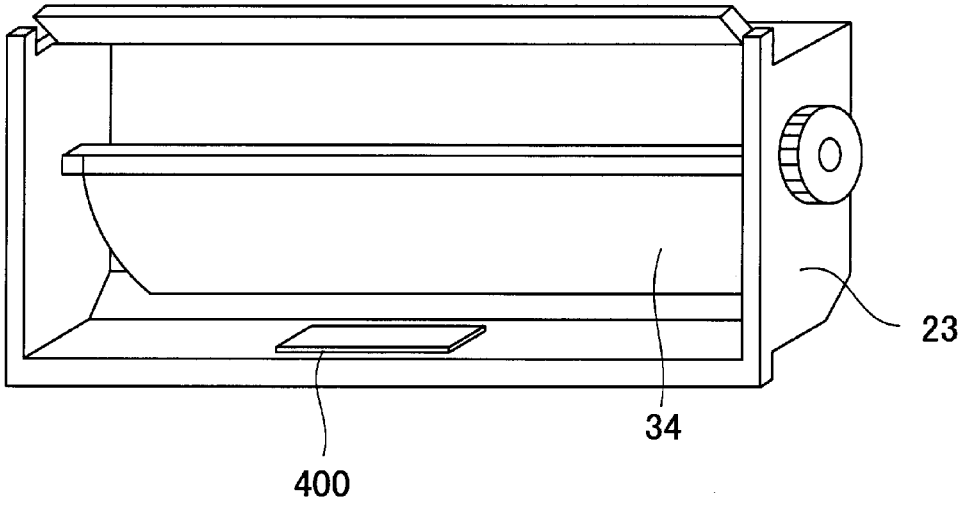
FIG. 9 is a schematic perspective view of the toner storage (minus its downstream wall in terms of rotational direction of toner stirrer), and show the positioning of the residual toner amount sensor.
Figure 10:
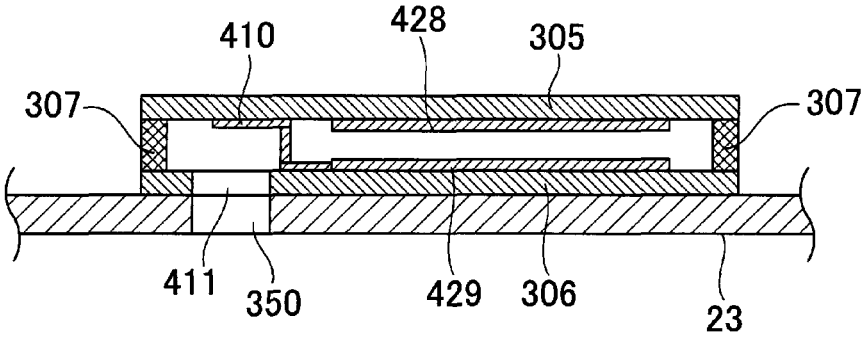
FIG. 10 is a schematic sectional view of the residual toner amount sensor, and the sensor mount portion of the bottom wall of the toner storage in the first embodiment, and show where and how the sensor is attached to the bottom wall.

Next, referring to FIGS. 9 and 10, the positions to which sensors 400 are attached are described. Here, the "sensor400" means both the pressure sensitive resistor 401 and sheet switch 421 described above. Referring to FIG. 9, the sensor 400 is attached to the inward surface of the bottom wall of the toner storage 23 in such a manner that the detection surface of the sensor 400 faces inward of the toner storage 23.

Next, referring to FIG. 10 which shows the state of the sensor 400 (sheet switch) attached to the toner storage 23, the bottom wall of the toner storage 23 is provided with a hole 350 (second hole) which corresponds in position to the hole 411 of the second sheet 306 of the sensor 400. It is through this hole 350 that the contact portions 410 can be connected to the external electrical terminals, such as electrical terminals of the main assembly 100 of the printer. For example, the printer may be structured so that the installation of the process cartridge 5 into the main assembly 100 of the printer causes the contact portions 410 to become connected to the external terminals of the main assembly 100 of the printer.

The sensor 400 is solidly attached to the inward surface of the bottom wall of the toner storage 23 so that the adjacencies of the hole 350 of the bottom wall of the toner storage 23 is airtightly sealed with the outward surface of the second sheet 306. As for the means for attaching the sensor 400 to the bottom wall of the toner storage 23, the second sheet 306 may be adhered to the inward surface of the bottom wall of the toner storage 23 with the use of adhesive, two-sided adhesive tape, or the like. Further, the second sheet 306 may be welded to the bottom wall of the toner storage 23 by ultrasonic welding. With the bottom sheet 306 being airtightly adhered to the bottom wall of the toner storage 23, it is possible to prevent the toner from entering between the second and first sheets 306 and 305.

<Effects of First Embodiment>

In this embodiment, the gap (space) between the second sheet 306 and first sheet 305 remains airtightly sealed from the internal space of the toner storage 23. Therefore, it is impossible for the toner particles, dust particles, etc., to enter the gap. Therefore, it is possible to prevent the problem that the amount of the residual toner in the toner storage 23 is inaccurately determined because of the intrusion of the toner particles, dust particles, etc., into the gap between the second and first sheets 306 and 305. Further, in the case where the pressure sensitive resistor is used as the sensor, the amount of the residual toner in the toner storage 23 is determined based on the changes in the amount of the electrical resistance detected by the pressure sensitive resistor, whereas in the case where the sheet switch is used as the sensor, the amount of the residual toner is determined based on the length of time the first sheet 305 of the sheet switch is under the pressure. Therefore, the amount of the residual toner in the toner storage 23 can be accurately and successively detected from when the toner storage 23 is completely full of toner to when the toner storage 23 runs out of toner. Further, even if the developing device is structured so that the stirrer 34 (made of Mylar) is rotated at a high speed, the amount of the residual toner in the toner storage 23 can be accurately determined.

Further, the residual toner amount detection sensor is attached to the inward surface of the bottom wall of the toner storage 23 so that the hole 411 of the second sheet 306 of the sensor, through which the contact points of the sensor can be connected to the external terminals, and the hole 350 of the bottom wall of the toner storage 23, through which the contact points of the sensor can be connected to the external terminals, align with each other. Therefore, the contact portions 410 of the sensor can be easily connected to the external terminals. Further, if the sensor is structured so that its contact portions are exposed outward of the toner storage 23 through these holes as shown in FIG. 10, it is even easier to connect the contact portions 410 to the external terminals.

Further, the residual toner amount detection sensor in this embodiment does not require a seal dedicated to prevent the problem that the toner in the toner storage 23 leaks out through the hole 350 of the bottom wall of the toner storage 23. That is, not only can this embodiment prevent the above described toner leak, but also, can provide the sensor with the passage through which the gap (space) between the second and first sheets can be vented.

As is evident from the description of the first preferred embodiment of the present invention given above, the present invention can provide a developing device and an image forming apparatus, which have a residual toner amount sensor capable of accurately and successively detecting the amount of the residual toner in their toner storage.

[Embodiment 2]

Figure 11:
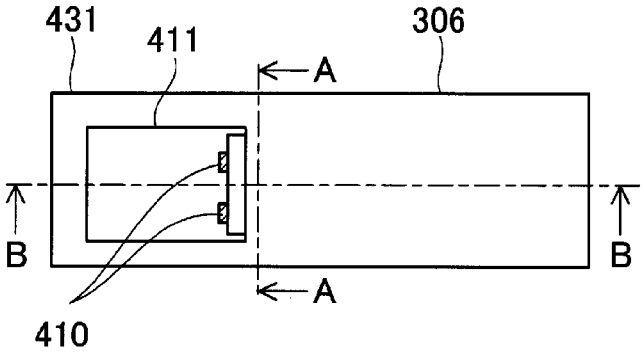
FIG. 11 is a schematic drawing for showing the general structure of the residual toner amount sensor in the second embodiment, FIGS. 11(*a*), 11(*b*) and 11(*c*) being a plan view, a sectional view at the line A-A in FIG. 11(*a*), and a sectional view at the line B-B in FIG. 11(*a*), respectively.
Figure 11:
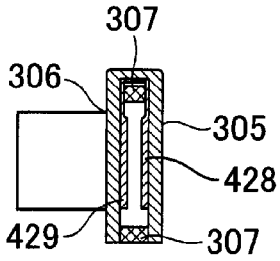
Figure 11:
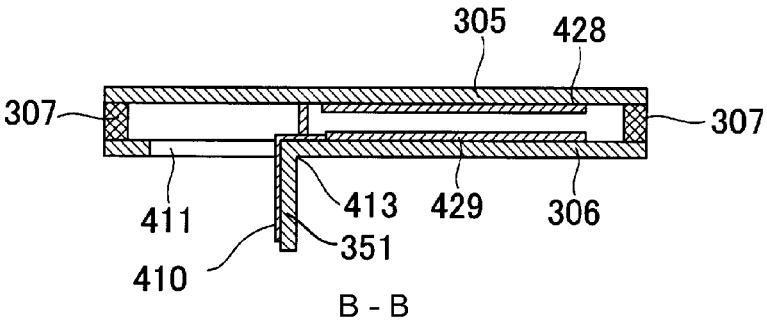
Figure 12:
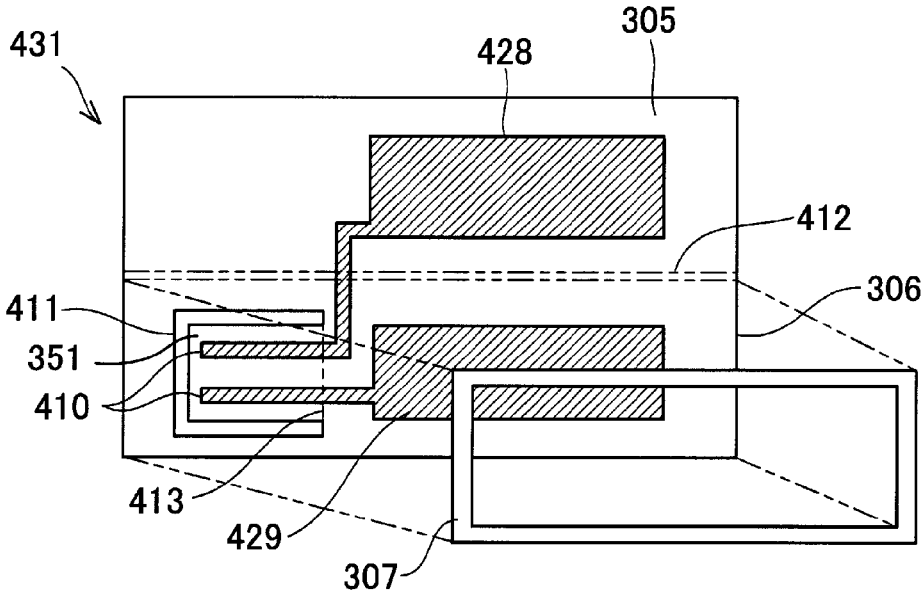
FIG. 12 is a schematic exploded perspective view of the residual toner amount sensor in the second embodiment, and shows the structure of the sensor.
Figure 13:
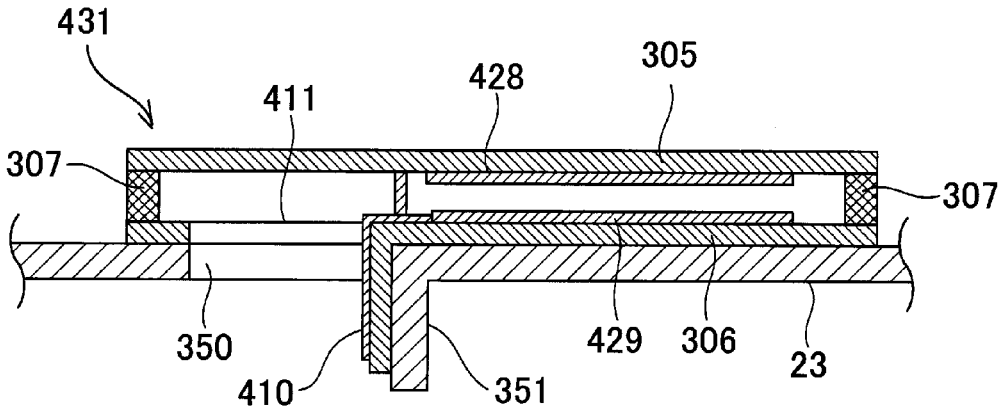
FIG. 13 is a schematic sectional view of the residual toner amount detection sensor and the sensor mount portion of the bottom wall of the toner storage in the second embodiment, and shows where and how the sensor is attached to the bottom wall.

Next, referring to FIGS. 11-13, the developing device and image forming apparatus in the second preferred embodiment of the present invention are described. The portions of the developing device and image forming apparatus, which are the same in structure as the counterparts in the first embodiment, are not described here. That is, only the residual toner amount detection sensor in this embodiment, which is different in structure from the sensor in the first embodiment, is described about its structure.

<2-1: General Structure of Residual Toner Amount Detection Sensor>

First, referring to FIGS. 11 and 12, the general structure of the residual toner amount detection sensor in this embodiment is described. Although FIGS. 11 and 12 show a residual toner amount detection sensor of the sheet switch type, the sensor may be of the pressure sensitive resistor type.

FIG. 11(*a*) is a schematic plan view of the sheet switch 431 as seen from the second sheet side. FIGS. 11(*b*) and 11(*c*) are schematic sectional views of the sheet switch 431 at planes A-A and B-B, respectively, in FIG. 11(*a*). Further, FIG. 12 is an exploded perspective view of the sheet switch 431 in this embodiment, and shows the structure of the sheet switch 431 and how the sheet switch 431 is assembled. The broken lines designated by a referential code 412 are the folding lines, and the broken line designated by a referential code 413 is the bending line. As described above, the second sheet 306 and first sheet 305 may be independent from each other, instead of being parts of a single large sheet.

The special feature of the residual toner amount detection sensor in this embodiment is that the electrical contact portion of the first sheet 305 of the sensor extends from the electrically conductive area of the first sheet 305 onto the inward surface of the second sheets 306, and the other electrical contact portion extends on the second sheet 306 from the electrically conductive area of the second sheet 306. More specifically, the two electrical contact portions 410 are on the portion of the inward surface of the second sheet 306, which is surrounded by a U-shaped slit. Thus, as the portion of the second sheet 306, which is surrounded the U-shaped slit, is bent outward of the sheet switch at the bending line 413, the electrical contact portions 410 are exposed from the sensor, and also, a hole 411 is created, which can be used as the hole for venting the gap (space) between the second sheet 306 and first sheet 305.

Shown in FIG. 13 is the state of the sheet switch 431 after the attachment of the sheet switch 431 to the toner storage 23. The bottom wall of the toner storage 23 is provided with a hole 350, with which the electrical contact portions 410 of the sheet switch 431 are roughly aligned when the sheet switch 431 is attached to the toner storage 23.

The method for attaching the sheet switch 431 to the toner storage 23 is as follows: First, the electrical contact portions 410 are to be bent outward along with the area of the second sheet 306, on which the electrical portions 410 are present. Then, the sheet switch 431 is positioned so that the combination of the electrical contact portion 410 and the bent portion of the second sheet 306 is supported by the electrical contact portion supporting portion 351 of the bottom wall of the toner storage 23, which is at one of the edges of the hole 350 of the bottom wall of the toner storage 23. With the sheet switch 431 positioned as described above, the electrical contact portions 410 are exposed from the toner storage 23. Then, the sheet switch 431 is to be airtightly adhered to the inward surface of the bottom wall of the toner storage 23 by the second sheet 306, and the bent portion of the bottom sheet 306, on which the electrical contact portions 410 are present, is to be airtightly adhered to the supporting portion 351, which is at one of the edges of the hole 350.

As for the means for solidly attaching the sheet switch 431 to the bottom wall of the toner storage 23, the second sheet 306 may be adhered to the inward surface of the bottom wall of the toner storage 23 with the use of adhesive, two-sided adhesive tape, or the like. Further, the second sheet 306 may be welded to the bottom wall of the toner storage 23 by ultrasonic welding. With the bottom sheet 306 being airtightly adhered, or welded, to the bottom wall, it is possible to prevent the toner from leaking from the toner storage 23 through the hole 350 of the bottom wall of the toner storage 23.

<2-3: Effects of Second Embodiment>

The second embodiment can provide the following effect in addition to those that can be provided by the first embodiment. That is, since the electrical contact portion 410 of the second sheet 306 and the electrical contact portion 410 of the first sheet 305 are exposed from the toner storage 23, they can be easily connected to the external terminals. For example, it is easier for the residual toner amount detection sensor to be become connected to the terminals (external terminals) of the main assembly 100 of the printer, when the process cartridge 5 is installed into the main assembly 100 of the printer.

Further, the electrical contact portions 410 of the sensor are supported by the sensor supporting portion 351 of the toner storage 23. Therefore, it is ensured that the electrical contact portions 410 remain connected to the external terminals. Thus, even if the electrical contact portions 410 are subjected to unintended force transmitted thereto through the external terminals due to the external shock, it is unlikely for the sensor to be peeled from the toner storage 23. In other words, not only can this embodiment provide the same effects as those provided by the first embodiment, but also, can prevent the problem that the sensor reduces in accuracy due to the loosening or separation of the sensor from the toner storage 23.

As is evident from the description of the second embodiment of the present invention given above, the present invention can provide a developing device and an image forming apparatus, which have a residual toner amount sensor capable of accurately and successively detecting the amount of the residual toner in their toner storage.

[Embodiment 3]

Figure 14:
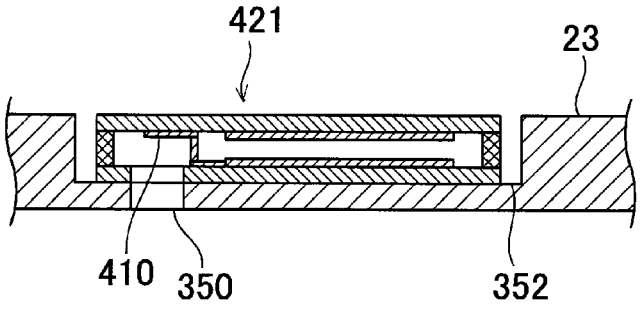
FIG. 14 is a schematic sectional view of the residual toner amount detection sensor and the sensor mount portion of the bottom wall of the toner storage in the third embodiment, and shows where and how the sensor is attached to the bottom wall.
Figure 14:
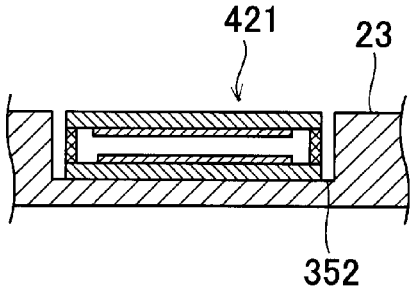

Next, referring to FIG. 14, the developing device and image forming apparatus in the third embodiment of the present invention are described. The portions of the developing device and image forming apparatus in this embodiment, which are the same in structure as the counterparts in the second embodiment are not going to be described here. That is, only their portions to which the residual toner amount detection sensor in this embodiment is attached is described. Although the sensor in FIG. 14 is of the sheet switch type, it may be of the pressure sensitive resistor type.

<3-1: General Structure of Sensor Mount>

FIG. 14(*a*) is a schematic sectional view of the sensor mount portion of the toner storage 23, at a plane perpendicular to the rotational direction of the toner stirrer 34 (made of Mylar). FIG. 14(*b*) is a schematic sectional view of the sensor mount portion of the toner storage 23, at a plane parallel to the rotational direction of the stirrer 34.

The special feature of this embodiment is that the bottom wall of the toner storage 23 is provided with an inwardly facing recess, the bottom surface 352 of which is used as the surface to which the sheet switch 421 is attached. Further, the recess is formed so that after the mounting of the sheet switch 431 into the recess, the top surface of the first sheet 305 is level with, or below, the inward surface of the bottom wall of the toner storage 23.

The bottom wall of the recess is provided with a hole 350. The sheet switch 421 is positioned so that its electrical contact portions 410 face the hole 350 of the bottom wall of the recess. Thus, after the attachment of the sheet switch 421, the electrical contact portions 410 remain exposed from the toner storage 23 through the hole 350.

The outward surface of the second sheet 306 is solidly and airtightly adhered to the sensor attachment surface 352 so that the adjacencies of the hole 350 remain airtightly sealed. As for the means solidly attaching the sheet switch 421, the second sheet 306 of the sheet switch 421 may be attached to the bottom surface of the recess with the use of adhesive, two-sided adhesive tape, or by ultrasonic welding. The structure of the sheet switch 421 in this embodiment is the same as that in the first embodiment described above.

<3-2: Effects of Third Embodiment>

In this embodiment, the residual toner amount sensor is placed in the recess of the bottom wall of the toner storage 23. Therefore, it is possible to prevent the problem that as the stirrer 34 is rotated, it comes into contact with the sensor by its edge. Therefore, it is possible to prevent the problem that the sensor is partially peeled, or entirely peeled away, from the inward surface of the bottom wall of the toner storage 23, and/or damaged, by the stirrer 34. Therefore, it is ensured that the sensor correctly and successively detects the amount of the residual toner in the toner storage 23.

As is evident from the description of the third embodiment of the present invention, the present invention can provide a developing device and an image forming apparatus, which have a residual toner amount sensor capable of accurately and successively detecting the amount of the residual toner in their toner storage.

[Embodiment 4]

Figure 15:
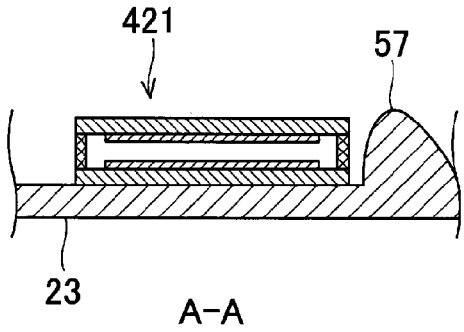
FIG. 15 is a schematic sectional view of the residual toner amount detection sensor and the sensor mount portion of the bottom wall of the toner storage in the fourth embodiment, and shows where and how the sensor is attached to the bottom wall.
Figure 15:
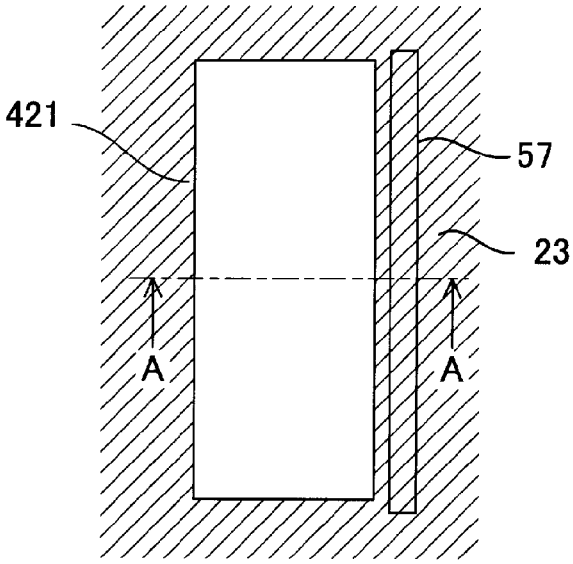

Next, referring to FIG. 15, the developing device and image forming apparatus in the fourth embodiment of the present invention is described. The portions of the developing device and image forming apparatus in this embodiment, which are the same in structure as the counterparts in the first to third embodiments are not going to described here. That is, only the structure of the mount for the residual toner amount detection sensor is described.

<4-1: General Structure of Sensor Mount>

FIG. 15(*a*) is a schematic sectional view of the sensor mount portion of the bottom wall of the toner storage 23, at a plane perpendicular to the rotational direction of the toner stirrer 34 (made of Mylar). FIG. 15(*b*) is a schematic plan view of the sensor mount portion of the bottom wall of the toner storage 23, as seen from the top side of the toner storage 23. Although the residual toner amount sensor illustrated in FIG. 15 is of the sheet switch type, the sensor may be of the pressure sensitive resistor type.

The bottom wall of the toner storage 23 is provided with a long and narrow ridge 57, which is adjacent to the upstream edge of the sheet switch mount, in terms of the stirrer 34. The height of the ridge 57 is such that its top is level with, or above, the detection surface of the first sheet 305 of the sheet switch 321.

<4-2: Effects of Fourth Embodiment>

Since the bottom wall of the toner storage 23 is structured as described above, and the sheet switch 421 is positioned as described above, it is possible to prevent the problem that as the stirrer 34 is rotated, the edge of the stirrer 34 comes into contact with the upstream top corner of the sheet switch 421 in terms of the rotational direction of the stirrer 34. Therefore, it is possible to prevent the problem that as the stirrer 34 is rotated, the sheet switch 421 (sensor) is partially peeled from, or entirely peeled away from, the sensor mount, and/or damaged, by the stirrer 34. Incidentally, the bottom wall of the toner storage 23 may be provided with two long and narrow ridges 57, which will be on both the upstream and downstream sides of the sensor.

As is evident from the description of the fourth embodiment of the present invention, the present invention can provide a developing device and an image forming apparatus, which have a residual toner amount sensor capable of accurately and successively detecting the amount of the residual toner in their toner storage.

[Embodiment 5]

Figure 16:
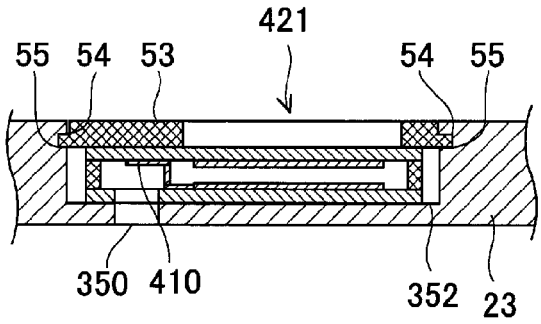
FIG. 16 is a schematic sectional view of the residual toner amount detection sensor and the sensor mount portion of the bottom wall of the toner storage in the fifth embodiment, and shows where and how the sensor is attached to the bottom wall.
Figure 16:
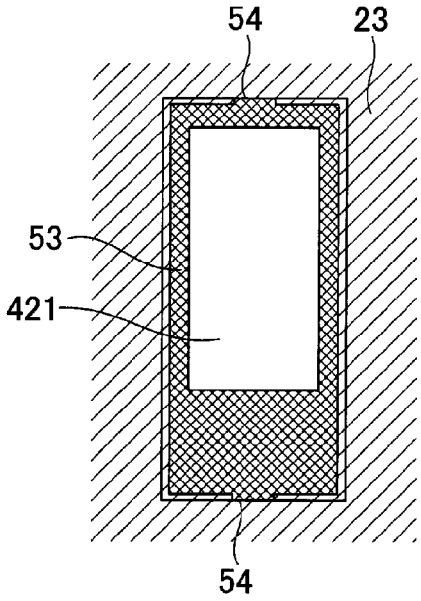

Next, referring to FIG. 16, the developing device and image forming apparatus in the fifth preferred embodiment of the present invention is described. The portions of the developing device and image forming apparatus, which are the same in structure as the counterparts in the first to fourth embodiment are not going to be described here. That is, only the structure of the sensor mount is described.

<5-1: General Structure of Sensor Mount>

FIG. 16(*a*) is a schematic sectional view of the sensor mount portion of the bottom wall of the toner storage 23 at a plane perpendicular to the rotational direction of the toner stirrer 34 (made of Mylar). FIG. 16(*b*) is a schematic plan view of the sensor mount portion of the bottom wall of the toner storage 23 as seen from the top side of the toner storage 23. Although the residual toner amount detection sensor illustrated in FIG. 16 is of the sheet switch type, the sensor may be of the pressure sensitive resistor type.

The special feature of this embodiment is that not only is the bottom wall of the toner storage 23 provided with an inward facing recess, in which the residual toner amount sensor is to be mounted as in the third embodiment, but also, it is provided with a sensor retainer 53 for retaining the sheet switch 421 in the recess.

The sensor retainer 53 is structured so that it retains the sheet switch 421 by being placed in contact with the portions of the first sheet 305 other than the detection surface of the first sheet 305. More specifically, the retainer 53 is provided with a pair of tongues which fit into the grooves 55 with which the bottom wall of the toner storage 23 is provided. The bottom wall of the toner storage 23, sheet switch 421, and retainer 53 are structured so that after the attachment of the sheet switch 421 and retainer 53 to the toner storage 23, the top surface of the retainer 53 is at the same level as, or a lower level than, the inward surface of the bottom wall of the toner storage 23.

Further, they are structured to position the sheet switch 421 so that the electrical contact portions 410 of the sheet switch 421 face the hole 350 of the bottom wall of the toner storage 23 as in the third embodiment. Therefore, the external terminals can be easily connected to the electrical contact portions 410.

<5-2: Effects of Fourth Embodiment>

In this embodiment, the residual toner amount detection sensor is attached in the recess of the bottom wall of the toner storage 23. Therefore, it is possible to prevent that problem that as the toner stirrer 34 is rotated, the edge of the stirrer 34 comes into contact with the sensor (sheet switch 421). Therefore, it is possible to prevent the problem that the as the stirrer 34 is rotated, the sensor is partially peeled from, or entirely peeled away from, the inward surface of the bottom wall of the toner storage 23, and/or damaged, by the stirrer 34. Further, the sensor is retained in the sensor placement recess by the retainer 53. Therefore, it is ensured that the sensor remains accurately positioned to accurately determine the amount of the residual toner in the toner storage 23.

As is evident from the description of this embodiment given above, the present invention can provide a developing device and an image forming apparatus, which have a residual toner amount sensor capable of accurately and successively detecting the amount of the residual toner in their toner storage.

[Embodiment 6]

Figure 17:
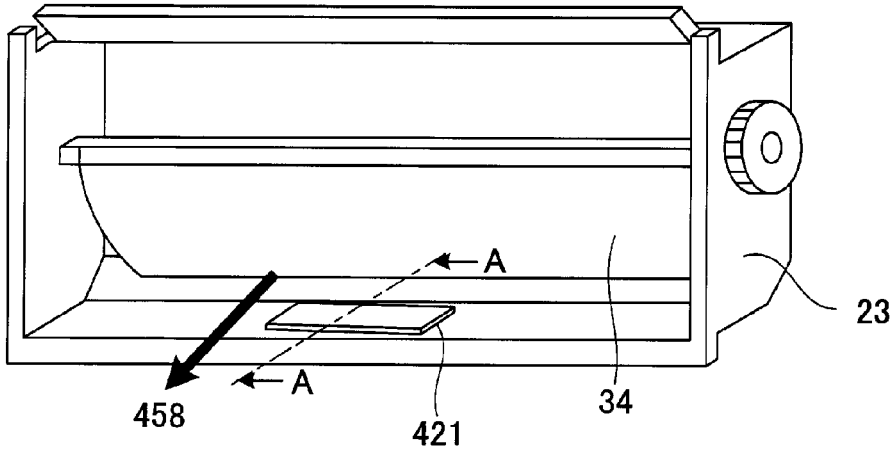
FIG. 17 is a schematic sectional view of the residual toner amount detection sensor and the sensor mount portion of the bottom wall of the toner storage in the sixth embodiment, and shows where and how the sensor is attached to the bottom wall.
Figure 17:
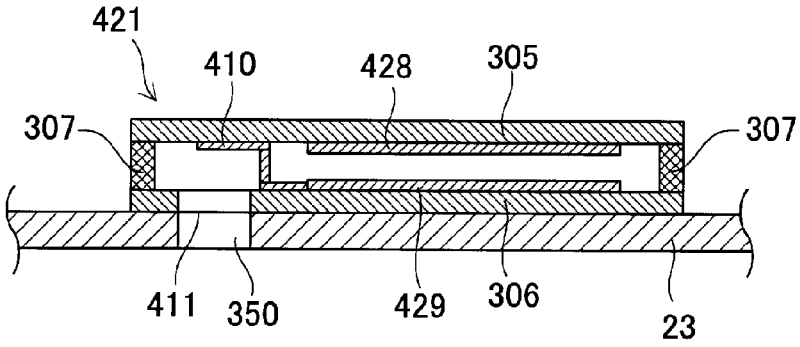

Next, referring to FIG. 17, the developing device and image forming apparatus in the sixth preferred embodiment of the present invention is described. The portions of the developing device and image forming apparatus, which are the same in structure as the counterparts in the first to fifth embodiments are not going to be described here. That is, only the structure of the sensor mount is described.

<6-1: Structure of Sensor Mount>

FIG. 17(*a*) is a schematic perspective view of the toner storage (minus its downstream wall in terms of rotational direction of toner stirrer), and shows how the sheet switch 421 is attached to the bottom wall of the toner storage 23. FIG. 17(*b*) is a schematic sectional view of the sheet switch 421 and its adjacencies, at a vertical plane which is perpendicular to the lengthwise direction of the sheet switch 421 and coincides with the line A-A in FIG. 17(*a*), after the attachment of the sheet switch 421.

Referring to FIG. 17(*a*), the sheet switch 421 is attached to the inward surface of the bottom wall of the toner storage 23 at an angle relative to the rotational direction of the stirrer 34 (made of Mylar). That is, the sheet switch 421 is attached so that the lengthwise direction of the sheet switch 421 does not become perpendicular to the rotational direction of the stirrer 34. As is evident from FIG. 17(*b*), the structure of the sheet switch 421 in this embodiment is the same as the structure of the sheet switch in one of the preceding embodiments, and therefore, is not going to be described here.

<6-2: Effects of Sixth Embodiment>

In this embodiment, the residual toner amount detection sensor is attached so that the lengthwise edges of the sensor are at an angel relative to the rotational direction of the stirrer 34 (made of Mylar). Thus, as the toner stirrer 34 is rotated, its stirring edge contacts the sensor in such a manner that it comes into contact with the most upstream corner of the sensor in terms of the rotational direction of the stirrer 34 first, and then, the point of contact between the stirring edge of the stirrer 34 and the upstream lengthwise corner of the sensor gradually shifts to the other corner. Therefore, compared to the preceding embodiments which make the lengthwise edges of the sensor perpendicular to the rotational direction of the stirrer 34, this embodiment is smaller in the amount of the pressure which the sensor catches from the stirrer 34. Therefore, this embodiment is superior to the preceding embodiments in terms of the prevention of the problem that the sensor is partially peeled from, or entirely peeled away from, the inward surface of the bottom wall of the toner storage 23, and/or is damaged, by the physical contact which occurs between the sensor and the stirrer 34 as the stirrer 34 is rotated. Therefore, this embodiment is superior to the preceding embodiments in terms of the accuracy with which the amount of the residual toner in the toner storage 23 can be detected, and also, the reliability of the sensor.

As is evident from the description of this embodiment of the present invention, the present invention can provide a developing device and an image forming apparatus, which have a residual toner amount sensor capable of accurately and successively detecting the amount of the residual toner in their toner storage.

[Miscellanies]

In the first to fifth embodiments of the present invention, the spacer 307 was placed between the second sheet 306 and first sheet 305. However, the means for providing a space between the two sheets 306 and 305 does not need to be limited to the spacer 307. That is, all that is necessary is to structure the sheet switch so that unless the first sheet 305 is subjected to the pressure from the stirrer 34, it does not deform; the first sheet 305 deforms only when it is subjected to the pressure from the stirrer 34. In other words, it is not mandatory that a spacer, such as the spacer 307, be placed between the two sheets 306 and 305. For example, a space may be provided between the sheets 306 and 305 by shaping one of the two sheets in the form of a shallow rectangular container with flange, and joining the two sheets at their edges.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 278392/2010 filed Dec. 14, 2010 which is hereby incorporated by reference.

What is claimed is:

1. A toner container comprising:

a toner accommodating portion:

a rotatable stirring member provided in said toner accommodating portion to stir the toner;

a sensor provided on an inner surface of said toner accommodating portion to detect a remaining amount of the toner accommodated in said toner accommodating portion;

wherein said sensor includes a first flexible sheet portion provided at a position opposing said stirring member;

a second sheet portion provided between an inner surface of said toner accommodating portion and said first sheet portion with a gap from said first sheet portion;

a first opening provided in said second sheet portion so as to be in communication with a space surrounded by said first sheet portion and said second sheet portion;

a first electroconductive portion provided on a surface of said first sheet portion opposing said second sheet portion; and a second electroconductive portion provided on a surface of said second sheet portion opposing said first sheet portion, wherein said first sheet portion flexes by a stirring operation of said stirring member, and said first electroconductive portion is contacted to said second electroconductive portion, by which said remaining toner amount is detectable, and wherein said toner accommodating portion is provided with a second opening for communicating said first opening and an outside of said toner accommodating portion with each other.

2. A toner container according to claim 1, wherein a contact portion extending from said second electroconductive portion is electrically connectable with an outer contact provided on an outside of said toner accommodating portion through said first opening and said second opening.

3. A toner container according to claim 2, wherein said contact portion is exposed to the outside through said first opening and said second opening, said toner container further comprises a supporting portion supporting said contact portion exposed to the outside.

4. A toner container according to claim 1, wherein the inner surface of said toner accommodating portion is provided with a projection adjacent said sensor and upstream of said sensor with respect to a rotational moving direction of said stirring member, and a top surface of said projection is the same as or higher than a position of said first sheet portion.

5. A toner container according to claim 1, wherein the inner surface of said toner accommodating portion is provided with a recess, and said sensor is provided in said recess so that said first sheet portion is accommodated in said recess.

6. A toner container according to claim 5, further comprising a holding member provided contacted to an upper surface of said first sheet portion and holding said sensor in said recess.

7. A toner container according to claim 1, wherein said sensor further includes a spacer provided between said first sheet portion and said second sheet portion to form the gap.

8. A developing apparatus comprising a developing member for supplying toner to an electrostatic latent image formed on an image bearing member, and the toner container according to claim 1, said toner container containing the toner.

9. A process cartridge detachably mountable to a main assembly of the image forming apparatus, said process cartridge comprising an image bearing member for bearing an electrostatic latent image, and the developing device according to claim 8.

10. An image forming apparatus comprising an image bearing member for bearing an electrostatic latent image, the developing device according to claim 8 for developing the electrostatic latent image into a toner image, and a transfer member for transferring the toner image formed on said image bearing member onto a transfer material.

* * * * *